US007458357B2

(12) United States Patent
Wallis

(10) Patent No.: US 7,458,357 B2
(45) Date of Patent: Dec. 2, 2008

(54) GAS SEALING ELEMENT FOR A ROTARY VALVE ENGINE

(75) Inventor: Anthony Bruce Wallis, Gladesville (AU)

(73) Assignee: Bishop Innovation Limited, North Ryde, New South Wales (AU)

( * ) Notice: Subject to any disclaimer, the term of this patent is extended or adjusted under 35 U.S.C. 154(b) by 119 days.

(21) Appl. No.: 11/659,694

(22) PCT Filed: Aug. 31, 2005

(86) PCT No.: PCT/AU2005/001309

§ 371 (c)(1),
(2), (4) Date: Feb. 8, 2007

(87) PCT Pub. No.: WO2006/024084

PCT Pub. Date: Mar. 9, 2006

(65) Prior Publication Data

US 2007/0266985 A1 Nov. 22, 2007

(30) Foreign Application Priority Data

Sep. 1, 2004 (AU) ..... 2004904982

(51) Int. Cl.
*F01L 7/16* (2006.01)

(52) U.S. Cl. ..... 123/190.17

(58) Field of Classification Search ..... 123/80 BA, 123/59.1, 190.1, 190.6, 190.8, 190.17
See application file for complete search history.

(56) References Cited

U.S. PATENT DOCUMENTS

| | | | | |
|---|---|---|---|---|
| 4,019,487 | A * | 4/1977 | Guenther | 123/190.17 |
| 4,444,161 | A | 4/1984 | Williams | |
| 4,852,532 | A | 8/1989 | Bishop | |
| 5,503,124 | A * | 4/1996 | Wallis | 123/190.1 |
| 5,526,780 | A | 6/1996 | Wallis | |
| 6,651,605 | B2 * | 11/2003 | Trentham | 123/190.8 |

* cited by examiner

*Primary Examiner*—Hai H Huynh
(74) *Attorney, Agent, or Firm*—Birch, Stewart, Kolasch & Birch, LLP

(57) ABSTRACT

A gas sealing element of an array of floating seals for a rotary valve internal combustion engine. The engine comprising a cylinder head (6) having a bore (8), a rotary valve (1) within the bore with a predetermined clearance, and a window (12) in the bore communicating with a combustion chamber. The sealing element (15) having an elongate form and having a sealing face (23), an underside (24) opposite said sealing face, and first and second side faces (25,26) opposite each other, the sealing element being adapted to be located in a slot (20) in the cylinder head bore. The side face (25) of the sealing element facing the window having at least one channel (17) extending from the sealing face to the underside of the sealing element.

9 Claims, 5 Drawing Sheets

GAS SEALING ELEMENT FOR A ROTARY VALVE ENGINE

TECHNICAL FIELD

This invention relates to gas sealing elements used in rotary valve internal combustion engines.

BACKGROUND

Rotary valve internal combustion engines having a rotary valve that rotates within a bore in the engine's cylinder head with a predetermined clearance have been described in several patents, including U.S. Pat. No. 5,526,780 (Wallis) and U.S. Pat. No. 4,852,532 (Bishop). Such rotary valve arrangements must have a sealing mechanism to seal the gap between the cylinder head bore and the rotary valve. This is preferably achieved by an array of floating gas sealing elements surrounding a window in the bore that communicates with the combustion chamber. Such sealing systems are also described in U.S. Pat. No. 5,526,780 (Wallis) and U.S. Pat. No. 4,852,532 (Bishop). Typically, each seal element is located in a corresponding slot in the cylinder head bore and preloaded against the outer diameter of the rotary valve. These sealing elements must seal the full cylinder combustion pressure, which may peak at 100 bar or greater. Each sealing element is designed to operate in a similar manner to a piston ring. The combustion gas from the cylinder flows into the slot, pushing the seal element against the outer face of the slot, and flows under the seal element to push it against the outside diameter of the valve. In this way the gas pressure acts to press the seal element against the two surfaces that it must seal with a force that is proportional to the pressure it must seal.

FIG. 1 shows a prior art axial sealing element, similar to that disclosed in U.S. Pat. No. 5,526,780 (Wallis), assembled into a rotary valve engine with a schematic steady state pressure distribution shown around it. In this example, prior art sealing element 31 is an axial sealing element with a constant rectangular cross section and parallel sides. Sealing element 31 is located in an axial slot 20 in the cylinder head bore 8, parallel to the axis of the rotary valve. Sealing element 31 is biased against the cylindrical portion 4 of the outside of the rotary valve by springs not shown. The force applied by these springs is indicated by arrow F. The clearances shown are exaggerated for the purposes of explaining the operation of the sealing element, and in practice the clearances are minimal. The pressure in the combustion chamber is indicated by $P_c$ and the flow of combustion gases into slot 20, through the clearance between the side of sealing element 31 and the side 35 of slot 20 closest to the combustion chamber window, as combustion pressure $P_c$ increases, is indicated by flow arrow 32. The pressure $P_{us}$ on the underside 34 of sealing element 31, which is the same as the pressure in the bottom of slot 20, is equal to the combustion pressure $P_c$. In this state, sealing element 31 seals the gap between cylinder head bore 8 and cylindrical portion 4 by being pressurised against cylindrical portion 4 and the side 33 of slot 20 furthest from the combustion chamber window.

The surfaces of the sealing element, the slot and the outside diameter of the valve are not perfectly flat and smooth so there will be a small amount of leakage across the faces that are to be sealed. This allows the establishment of a pressure distribution on these surfaces opposing the closing force generated by the free access of gas to the surfaces opposite to the sealing surfaces. This pressure distribution is typically triangular in shape as is shown in FIG. 1 by the pressure distribution between sealing element 31 and cylindrical portion 4, and between sealing element 31 and the side 33 of slot 20 furthest from the combustion chamber window.

Generally speaking, at slow to moderate engine speeds, $P_{us}$ is approximately equal to $P_c$ (as shown in FIG. 1) with the result that the sealing elements are adequately pressurised against the valve to seal successfully. However, at high engine speeds the pressure $P_{us}$ on the underside of the sealing element may be inadequate to resist the combustion pressure and as a result, the sealing element may be forced away from the valve causing the sealing to fail.

The volume underneath the sealing element determines the mass of gas that must be transported into this area in order to pressurise it. This volume acts as a capacitor and consequently the pressure $P_{us}$ on the underside of the sealing element lags the combustion pressure $P_c$ that the sealing element must seal against. The magnitude of this pressure lag is a function of the volume, the flow area feeding the volume, the radial depth of the sealing element, and the engine speed. The pressure lag increases when engine speed, volume or radial depth increases, or flow area decreases. The flow area is proportional to the side clearance of the sealing element in its slot, which is generally kept to an absolute minimum consistent with the sealing element always being free to move. This minimises the crevice volume and the fore and aft movement of the sealing element in its slot. The gas velocity through this side clearance is proportional to the pressure lag but the velocity is limited to Mach 1, which is when the flow becomes choked.

Minimising the clearance between the underside of the sealing element and the bottom of its slot minimises the volume underneath the sealing element. However, the sealing element must have some clearance for proper operation and assembly, and therefore there is a limit to the extent that this volume can be minimised.

FIG. 2 is the same as FIG. 1 except with a pressure lag as described above. The pressure lag is graphically indicated by the magnitude of $P_{us}$ being significantly less than $P_c$. It can be easily demonstrated that in order for sealing element 31 to remain preloaded against cylindrical portion 4 the following condition must be true.

$$P_{us}>0.5(P_c)-F/A$$

Where 'A' is the area of the underside 34 of sealing element 31 and so 'F/A' is the effective pressure generated by bias spring force 'F'. However, 'F/A' is generally small compared to the combustion pressure $P_c$, so the above condition can be simplified as follows.

$$P_{us}>0.5(P_c)$$

For any given sealing element arrangement, the pressure lag will increase with increasing engine speed until a point is reached where this condition is no longer true and the force acting on the top face of the sealing element exceeds that acting on its underside. When this occurs the sealing element will be forced away from the surface of the rotary valve with consequent collapse of sealing. The engine speed at which this occurs will be a function of the sealing element side clearance, radial depth and the volume underneath the sealing element.

In some circumstances, a sealing element may be forced into contact with the side of its slot that is closest to the combustion chamber window. A typical example of this is the leading axial sealing element. The friction between the sealing element and the rotating valve, against which it is preloaded, pushes the leading axial sealing element into contact with the slot side closest to the window. Another situation where this occurs is when the engine is running at closed throttle and a high vacuum exists in the cylinder, which tends to pull the sealing elements inwards against the sides of their slots closest to the window. In these situations the rising cylinder pressure during compression and combustion must first push the sealing element away from its slot side closest to the window, before gas flow can commence between the sealing element and the slot side to the underside of the sealing element. However, in these circumstances the cylinder pressure initially only sees that portion of the sealing element protruding above the slot. Consequently considerable pressure is required to force the sealing element away from the slot side closest to the window, which exacerbates the pressure lag and lowers the engine speed at which collapse of sealing commences.

The present invention seeks to provide a sealing element that at least ameliorates some of the problems of the prior art.

SUMMARY OF INVENTION

The present invention consists of a gas sealing element for a rotary valve internal combustion engine, said engine comprising a cylinder head having a bore, a rotary valve rotatable within said bore with a predetermined clearance, and a window in said bore communicating with a combustion chamber, said sealing element having an elongate form and having a sealing face, an underside opposite said sealing face, and first and second side faces opposite each other, said sealing element being adapted to be located in a slot in said bore adjacent to said window, with said first side face adjacent to the side of said slot closest to said window, and with said sealing face being biased against said valve, characterised in that said first side face has at least one channel disposed therein extending from said sealing face to said underside.

Preferably said gas sealing element is adapted to be one of an array of floating seals surrounding said window. Preferably said at least one channel is a plurality of spaced apart channels. Preferably said channel is a recess substantially parallel to said first side face.

In one preferred embodiment, said gas sealing element is adapted to be disposed substantially parallel to the axis of said bore. Preferably the width of said sealing element, between said side faces, is less than its depth. Preferably said at least one channel lies within the axial extremities of said window.

In another preferred embodiment, said gas sealing element is substantially arcuate and adapted to be disposed in a plane substantially perpendicular to the axis of said bore. Preferably said at least one channel lies within the circumferential extremities of said window.

BEST MODE OF CARRYING OUT THE INVENTION

Figure 1:
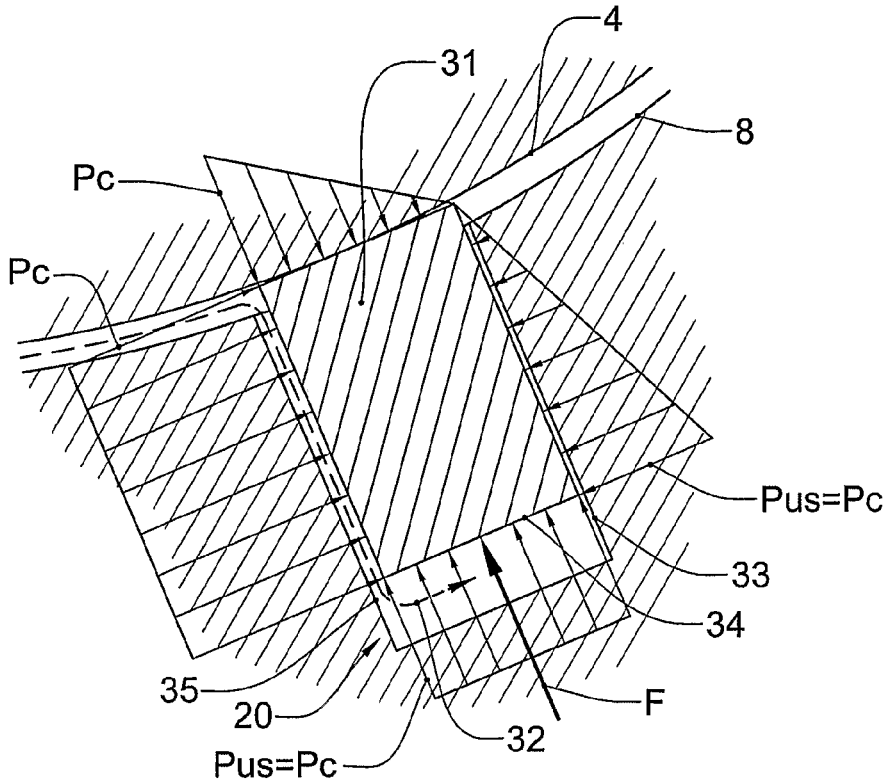
FIG. 1 depicts the pressure distribution around a prior art sealing element in the case where there is no pressure lag.
Figure 2:
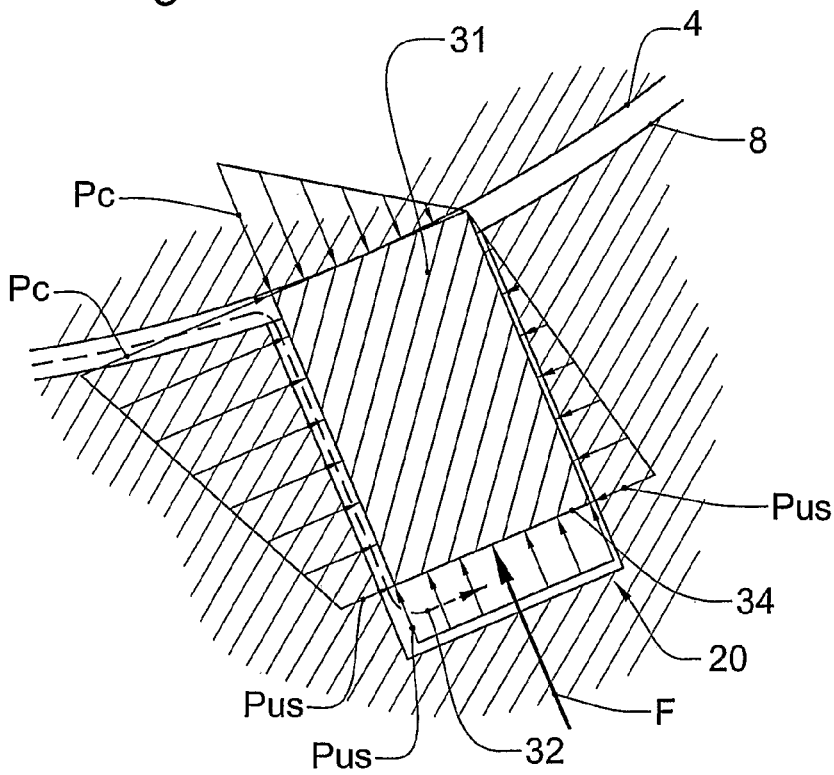
FIG. 2 depicts the pressure distribution around a prior art sealing element in the case where there is a pressure lag.
Figure 3:
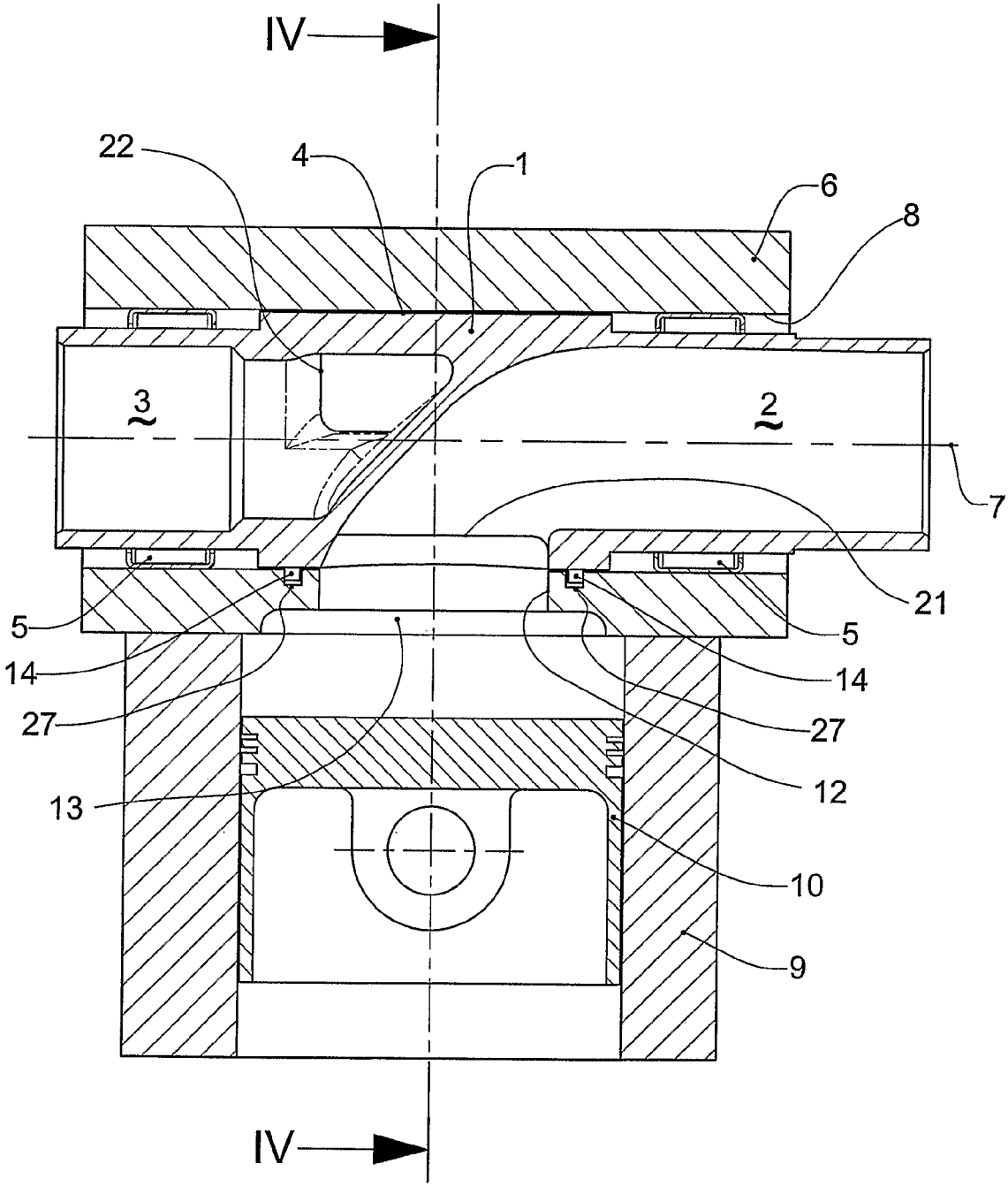
FIG. 3 is a cross sectional view of a rotary valve internal combustion engine having gas sealing elements in accordance with the present invention.
Figure 4:
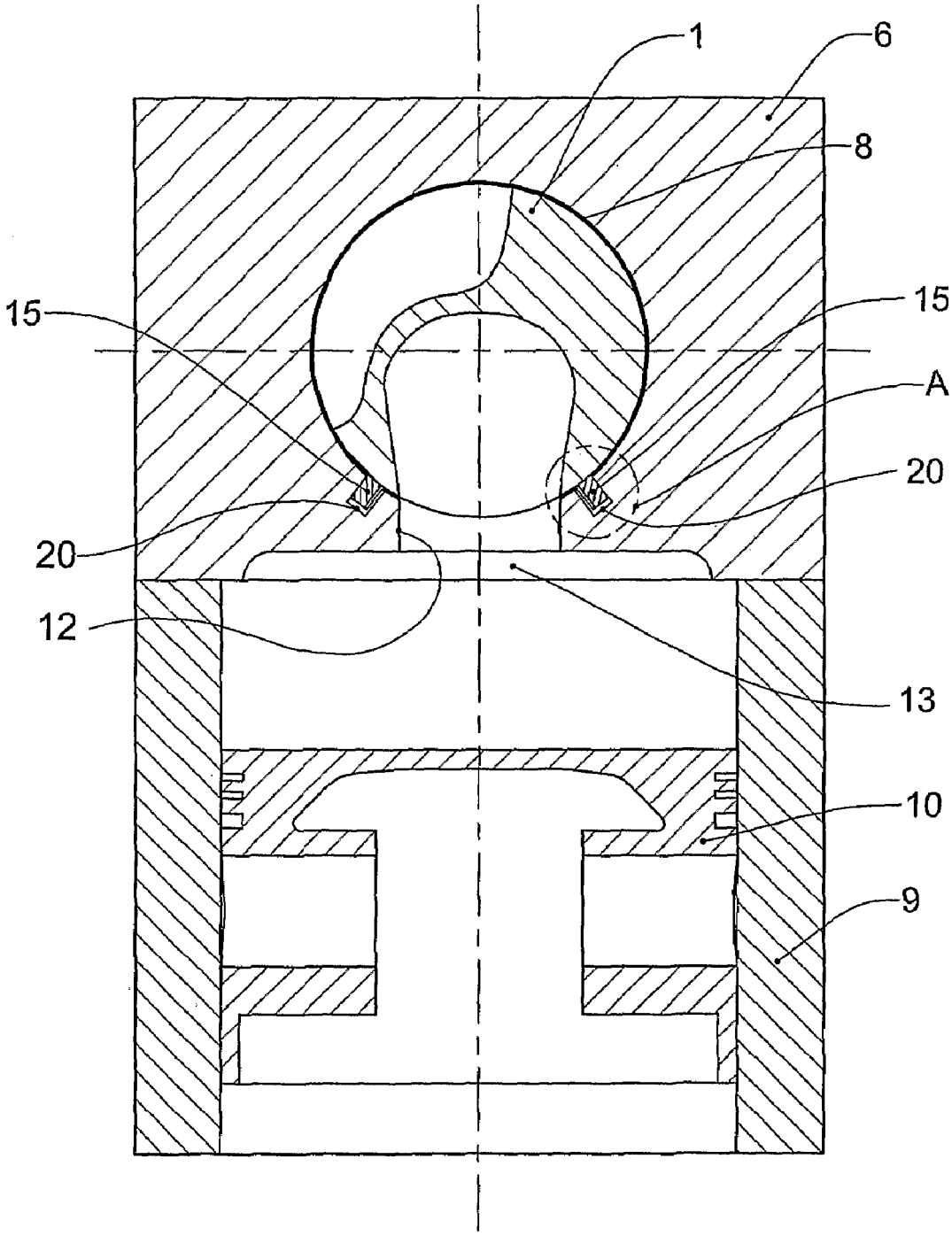
FIG. 4 is a cross sectional view along line IV-IV of FIG. 3.

FIGS. 3 and 4 depict a rotary valve internal combustion engine having gas sealing elements 14 and 15 in accordance with the present invention. Cylinder head 6 is mounted on top of cylinder block 9, and piston 10 reciprocates within cylinder block 9. Axial flow rotary valve 1 is supported for rotation within bore 8 in cylinder head 6, about cylinder head bore axis 7, by bearings 5 with a small predetermined clearance between central cylindrical portion 4, on the outer surface of valve 1, and bore 8.

Rotary valve 1 has an inlet port 2, and an exhaust port 3 terminating respectively at an inlet opening 21 and an exhaust opening 22 in cylindrical portion 4. As valve 1 rotates, inlet opening 21 and exhaust opening 22 periodically align with window 12 in bore 8, allowing the passage of gases between valve 1 and combustion chamber 13. The operation of similar rotary valve engines is described in more detail in U.S. Pat. No. 5,526,780 (Wallis).

During the compression and power strokes the high pressure combustion gases in combustion chamber 13 are prevented from escaping through the small running clearance between cylindrical portion 4 and bore 8 by an array of floating gas sealing elements surrounding window 12. The array of floating sealing elements comprises two axial sealing elements 15 and two circumferential sealing elements 14. Axial sealing elements 15 are disposed substantially parallel to bore axis 7, and are located in axial slots 20 adjacent to each side of window 12. Circumferential sealing elements 14 are located in circumferential slots 27 adjacent to each end of window 12. Each circumferential sealing element 14 lies in a respective plane substantially perpendicular to bore axis 7.

The array of sealing elements is biased against cylindrical portion 4 by springs not shown. Preferably, each axial sealing element 15 is biased against cylindrical portion 4 by individual springs underneath both ends thereof. Preferably, each circumferential sealing element 14 is biased against cylindrical portion 4 by a single elongate spring along the underside thereof.

Figure 6:
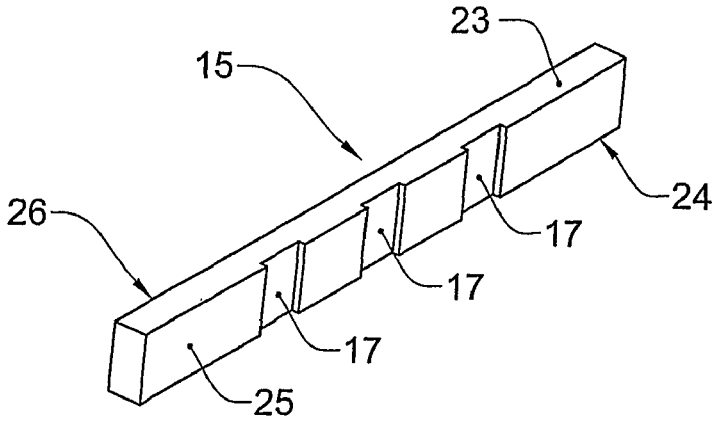
FIG. 6 is a perspective view of an axial sealing element of the engine of FIG. 3.

Referring to FIG. 6, axial sealing element 15 is straight and elongate with a rectangular cross section. Axial sealing element 15 has a sealing face 23, an underside 24 opposite sealing face 23, and side faces 25 and 26 opposite and parallel to each other. Side face 25 has three channels 17 disposed therein, each extending from sealing face 23 to underside 24. Channels 17 are in the form of shallow recesses substantially parallel to side face 25. The depth of channels 17 is small relative to the width of axial sealing element 15. In a motor car engine, channels 17 may for example each be approximately 0.1 mm deep and 3 to 5 mm wide measured along the length of sealing element 15. The width of axial sealing element 15, measured between side faces 25 and 26, is preferably less than its depth, measured between sealing face 23 and underside 24. Channels 17 are substantially equally spaced apart and are positioned along the length of sealing element 15 such that when sealing element 15 is located in slot 20, channels 17 are all within the axial extremities of window 12. Axial sealing element 15 may be made from steel.

Figure 5:
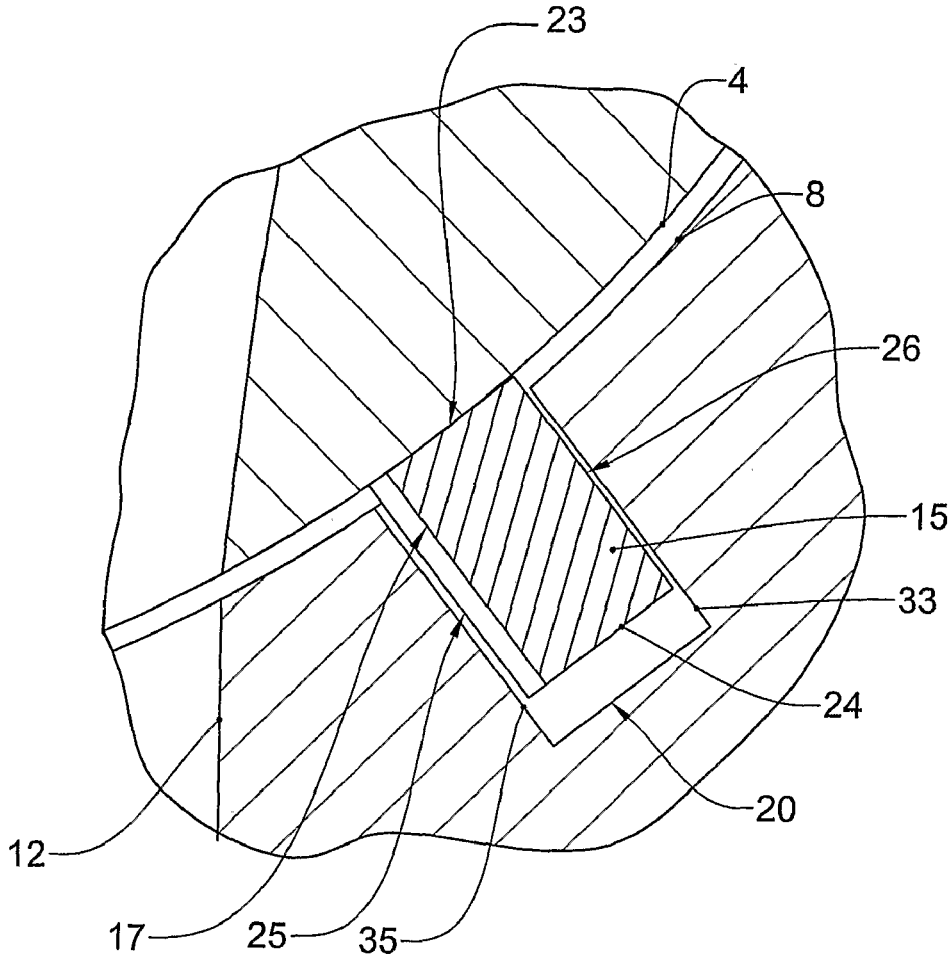
FIG. 5 is an enlarged view of circle 'A' of FIG. 4 detailing an axial sealing element.

Referring to FIG. 5, axial sealing element 15 is located in axial slot 20 with side face 25, having channels 17, adjacent to the side 35 of slot 20 closest to window 12, and with side face 26 adjacent to the side 33 of slot 20 furthest from window 12. The clearance between the side faces 25 and 26 of axial sealing element 15 and slot 20 is as small as possible consistent with the sealing element always being free to move for the reasons given in the background. Sealing face 23 is biased against cylindrical portion 4.

Channels 17 have two functions. Firstly, they provide sufficient flow area between axial sealing element 15 and slot side 35 closest to window 12 to ensure that the magnitude of the pressure lag between the combustion pressure $P_c$ and the pressure $P_{us}$ at the underside 24 of sealing element 15 is small enough that there is always a net force pushing sealing element 15 against cylindrical portion 4, even at high engine speeds. Secondly, channels 17 provide a flow path to the underside 24 of sealing element 15 if sealing element 15 is forced into contact with slot side 35 closest to window 12 by friction or vacuum as described in the background. Channels 17 then provide a greatly increased area for the gas pressure to act on to push sealing element 15 against the slot side 33 furthest from window 12.

Figure 7:
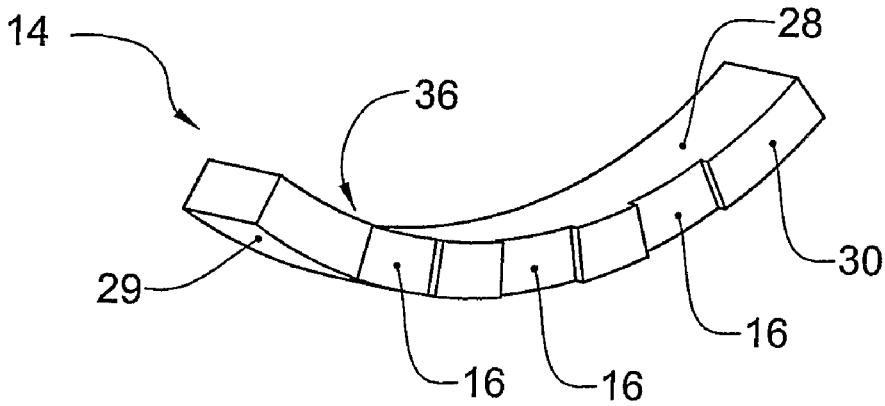
FIG. 7 is a perspective view of a circumferential sealing element of the engine of FIG. 3.

Referring to FIG. 7, circumferential sealing element 14 is arcuate and elongate with a sealing face 28, an underside 29 opposite sealing face 28, and side faces 30 and 36 opposite and parallel to each other. Side face 30 has three channels 16 disposed therein, each extending from sealing face 28 to underside 29. Like channels 17, channels 16 are in the form of shallow recesses substantially parallel to side face 30. Channels 16 have similar proportions to channels 17 in axial sealing element 15. Channels 16 are substantially equally spaced apart and are positioned along the length of sealing element 14 such that when sealing element 14 is located in circumferential slot 27, channels 16 are all within the circumferential extremities of window 12. Circumferential sealing element 14 may be made from steel.

Circumferential sealing element 14 is located in circumferential slot 27 with side face 30, having channels 16, adjacent to the side of slot 27 closest to window 12. As with axial sealing elements 15, the clearance between the side faces 30 and 36 of circumferential sealing element 14 and slot 27 is as small as possible consistent with the sealing element always being free to move. Sealing face 28 is biased against cylindrical portion 4. Channels 16 serve the same purpose as channels 17, as described above.

In other not shown embodiments the number, depth and width of channels may vary depending on the details of the engine and its operating speed. Also the channels may have other shapes, rather than shallow recesses, as long as they provide a gas path from the sealing face to the underside of the sealing element. Furthermore, although the preferred embodiments have the channels within the circumferential and axial extremities of the window this is not essential and in some applications the channels may be partially or wholly outside the extremities of the window.

The term "comprising" as used herein is used in the inclusive sense of "including" or "having" and not in the exclusive sense of "consisting only of".

The invention claimed is:

1. A gas sealing element for a rotary valve internal combustion engine, said engine comprising a cylinder head having a bore, a rotary valve rotatable within said bore with a predetermined clearance, and a window in said bore communicating with a combustion chamber, said sealing element having an elongate form and having a sealing face, an underside opposite said sealing face, and first and second side faces opposite each other, said sealing element being adapted to be located in a slot in said bore adjacent to said window, with said first side face adjacent to the side of said slot closest to said window, and with said sealing face being biased against said valve, characterised in that said first side face has at least one channel disposed therein extending from said sealing face to said underside.

2. A gas sealing element as claimed in claim 1 wherein said gas sealing element is adapted to be one of an array of floating seals surrounding said window.

3. A gas sealing element as claimed in claim 1 wherein said gas sealing element is adapted to be disposed substantially parallel to the axis of said bore.

4. A gas sealing element as claimed in claim 3 wherein the width of said sealing element, between said side faces, is less than its depth.

5. A gas sealing element as claimed in claim 3 wherein said at least one channel lies within the axial extremities of said window.

6. A gas sealing element as claimed in claim 1 wherein said gas sealing element is substantially arcuate and adapted to be disposed in a plane substantially perpendicular to the axis of said bore.

7. A gas sealing element as claimed in claim 6 wherein said at least one channel lies within the circumferential extremities of said window.

8. A gas sealing element as claimed in claim 1 wherein said at least one channel is a plurality of spaced apart channels.

9. A gas sealing element as claimed in claim 1 wherein said channel is a recess substantially parallel to said first side face.

* * * * *